US009845565B2

(12) United States Patent
Hwang

(10) Patent No.: US 9,845,565 B2
(45) Date of Patent: Dec. 19, 2017

(54) DRAINAGE DEVICE FOR WALL-MOUNTED WASHING MACHINE

(71) Applicant: Dongbu Daewoo Electronics Corporation, Seoul (KR)

(72) Inventor: Ui Kun Hwang, Bucheon-si (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 163 days.

(21) Appl. No.: 14/095,610

(22) Filed: Dec. 3, 2013

(65) Prior Publication Data

US 2015/0129058 A1 May 14, 2015

(30) Foreign Application Priority Data

Nov. 11, 2013 (KR) ..... 10-2013-0135972

(51) Int. Cl.

| | |
|---|---|
| ***F16K 37/00*** | (2006.01) |
| ***D06F 39/10*** | (2006.01) |
| ***D06F 39/08*** | (2006.01) |
| *E03C 1/282* | (2006.01) |

(52) U.S. Cl.

CPC ..... *D06F 39/10* (2013.01); *D06F 39/08* (2013.01); *E03C 1/282* (2013.01); *Y10T 137/794* (2015.04)

(58) Field of Classification Search

CPC ..... D06F 39/10; D06F 39/086; D06F 39/08; D06F 39/083; E03C 1/262; E03C 1/264

USPC ..... 137/546; 68/2.13, 18 F, 208

See application file for complete search history.

(56) References Cited

U.S. PATENT DOCUMENTS

| | | | | |
|---|---|---|---|---|
| 1,018,560 | A * | 2/1912 | Hemme | 137/546 |
| 2,900,080 | A * | 8/1959 | Worst et al. | 210/171 |
| 3,236,386 | A * | 2/1966 | Salisbury et al. | 210/532.2 |
| 6,915,814 | B2 * | 7/2005 | Cheng | 137/247.51 |
| 7,357,148 | B1 * | 4/2008 | Gibson | 137/360 |
| 2005/0120758 | A1 * | 6/2005 | Thies | D06F 39/10 68/18 R |
| 2005/0246843 | A1 * | 11/2005 | Song et al. | 8/158 |

(Continued)

FOREIGN PATENT DOCUMENTS

| | | |
|---|---|---|
| CN | 2600470 | 1/2004 |
| JP | 2002-104454 | 4/2002 |

(Continued)

OTHER PUBLICATIONS

Hwang, Ui Kun; Wall-hanging Mini Drum Washing Machine Capable of Reducing Sizes by Improving Installation Structure, Abstract of KR Patent Application 10-2011-0131332, Jun. 18, 2013.

(Continued)

*Primary Examiner* — Jessica Cahill
*Assistant Examiner* — Angelisa L Hicks

(57) ABSTRACT

A drainage device for a wall-mounted washing machine includes a drain housing having an inlet at an upper side of a body, a valve wall in the body, a drain and a cap receiver at a lower side of the body opposite to the inlet relative to the valve wall, and a driving unit or actuator receiver on the valve wall, a cap on the cap receiver configured to collect foreign materials; and a driving unit or actuator in the driving unit or actuator receiver, configured to open and close the valve wall. As a result, the user cannot come in contact with the inlet, thereby preventing accidents or burns from components in or near the inlet, such as a heater.

17 Claims, 10 Drawing Sheets

(56) References Cited

U.S. PATENT DOCUMENTS

| | | | | |
|---|---|---|---|---|
| 2007/0240457 | A1* | 10/2007 | Jang et al. | 68/18 F |
| 2008/0053881 | A1 | 3/2008 | Gurmu | |
| 2012/0186306 | A1* | 7/2012 | Kim et al. | 68/18 F |
| 2012/0242205 | A1* | 9/2012 | Del Pos | D06F 39/125 312/228 |
| 2013/0025329 | A1* | 1/2013 | Namkung | 68/131 |

FOREIGN PATENT DOCUMENTS

| | | | | | |
|---|---|---|---|---|---|
| JP | 2002104454 | A | * | 4/2002 | |
| JP | 2002126393 | A | * | 5/2002 | D06F 39/08 |
| KR | 20130020394 | | | 2/2013 | |
| KR | 10-2013-0064624 | A | | 6/2013 | |

OTHER PUBLICATIONS

The extended European Search Report dated May 18, 2015, issued in corresponding European Patent Application No. 14177124.6.
Chinese Office Action; CN201310680774.9; (2016033101433220); Dated Apr. 6, 2016; 8 pages.

* cited by examiner

DRAINAGE DEVICE FOR WALL-MOUNTED WASHING MACHINE

CROSS-REFERENCE TO RELATED APPLICATIONS

This application is based on and claims priority from Korean Patent Application No. 10-2013-0135972, filed on Nov. 11, 2013, the disclosure of which is incorporated herein in its entirety by reference.

TECHNICAL FIELD

The present disclosure relates to a drainage device for a wall-mounted washing machine, and more particularly, to a drainage device for a wall-mounted washing machine that can safely and easily remove foreign materials such as coins and buttons, from the drainage water and/or passage.

BACKGROUND

In general, a wall-mounted washing machine has a small exterior size and may be installed on a wall. As a result, it is known that the wall-mounted washing machine has high spatial utilization in a narrow space.

A general configuration of the wall-mounted washing machine is disclosed in Korean Patent Application Laid-Open No. 10-2013-0064624 (Jun. 18, 2013). According to Korean Patent Application Laid-Open No. 10-2013-0064624 (Jun. 18, 2013), the wall-mounted washing machine includes a cabinet, a motor, a drum, a heater, a door, a drainage device, and the like. Hereinafter, the wall-mounted washing machine may be referred to as a washing machine.

Foreign materials such as coins, buttons, or small articles may be in with the laundry that is placed in the washer. A drainage process may be performed during or after washing, and the aforementioned foreign materials should be filtered and not discharged through the drain while draining.

The aforementioned foreign materials may be filtered by the drainage device. A drainage device known in the related art disclosed in Korean Patent Application Laid-Open No. 10-2013-0064624 (Jun. 18, 2013).

Meanwhile, since the foreign materials may interfere with drainage, the foreign materials need to be removed. The drainage device needs to be disassembled and cleaned, and subsequently reassembled in order to remove the foreign materials. In some cases, there may be a safety risk if internal components of the washing machine are close to the drain plug or cap. Also, in cases where the drain plug or cap simply screws on and unscrews off, there may be a risk that small children can take off the drain cap at an inappropriate time. Thus, this process may be very complicated, risky, and/or unsafe.

SUMMARY

The present disclosure has been made in an effort to provide a drainage device for a wall-mounted washing machine that enables the drainage device to be more easily disassembled and assembled when foreign materials collected in the drainage device are removed, and can prevent a safety risks and/or accidents from internal components in the washing machine, such as a heater.

Embodiments of the present disclosure provide an exemplary drainage device for a wall-mounted washing machine, including (i) a drain housing 500 having an inlet 520 at an upper side of a body 510, a valve wall 512 in the body 510, a drain 530 and a cap receiver 540 at a lower side of the body 510 opposite the inlet 520, and a driving unit receiver 580 on or adjacent to the valve wall 512; (ii) a cap on or secured to the cap receiver 540, configured to collect foreign material; and (iii) a driving unit or actuator 700 in or on the driving unit receiver 580, and configured to open and close the valve wall 512.

In the drainage device for a wall-mounted washing machine according to embodiments of the present disclosure, a route and/or path from the inlet 520 to the cap receiver 540 may be angled, curved, bent or zigzagged.

In the cap 600 of the drainage device for a wall-mounted washing machine according to embodiments of the present disclosure, a slot or groove 680 may be at a lower side of a cap body 610 and have a concave shape, and a tool (e.g., a Phillips head screwdriver) may be inserted in the slot or groove 680 to rotate the cap 600.

A pocket or well 650 may be at or in an upper center of the cap body 610 in the cap 600 of the drainage device according to embodiments of the present disclosure. The pocket 650 may have a depth h1 that is 80 to 95% of an entire height h2 of the cap 300.

The driving unit receiver 580 is outside of the valve wall 212.

Various embodiments of the present disclosure provide an exemplary drainage device, including (i) a drain housing 500 having an inlet 520 at an upper side of a body 510, a valve wall 512 in the body 510, a drain 530 and a cap receiver 540 at a lower side of the body 510 opposite the inlet 520, and a driving unit receiver 580 outside of the valve wall 512; (ii) a cap 600 on the cap receiver 540, having a slot or groove 680 at a lower side, the slot or groove 580 having a concave shape; and (iii) a driving unit or actuator 700 in or attached to the drain housing 500 and configured to open and close the valve wall 512.

In the drainage device according to various embodiments of the present disclosure, a route and/or path from the inlet 520 to the cap receiver 540 may be angled, curved, bent or zigzagged.

A pocket or well 650 may be at or in an upper center in the cap 600 of the drainage device according to embodiment(s) of the present disclosure. The pocket 650 may have a depth h1 that is 80 to 95% of an entire height h2 of the cap 600 for collecting foreign materials in the pocket 650.

Additional details of the exemplary embodiments are included in the detailed description and the drawings.

In a drainage device according to embodiments of the present disclosure, having the cap separate from the drain housing prevents direct contact with the internal components of the wall-mounted washing machine, such as a heater when removing the foreign material from the drain housing, thereby increasing safety.

The drainage device according to embodiments of the present disclosure advantageously provides a cap that may be easily removed and attached, and may easily allow removal of foreign materials.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
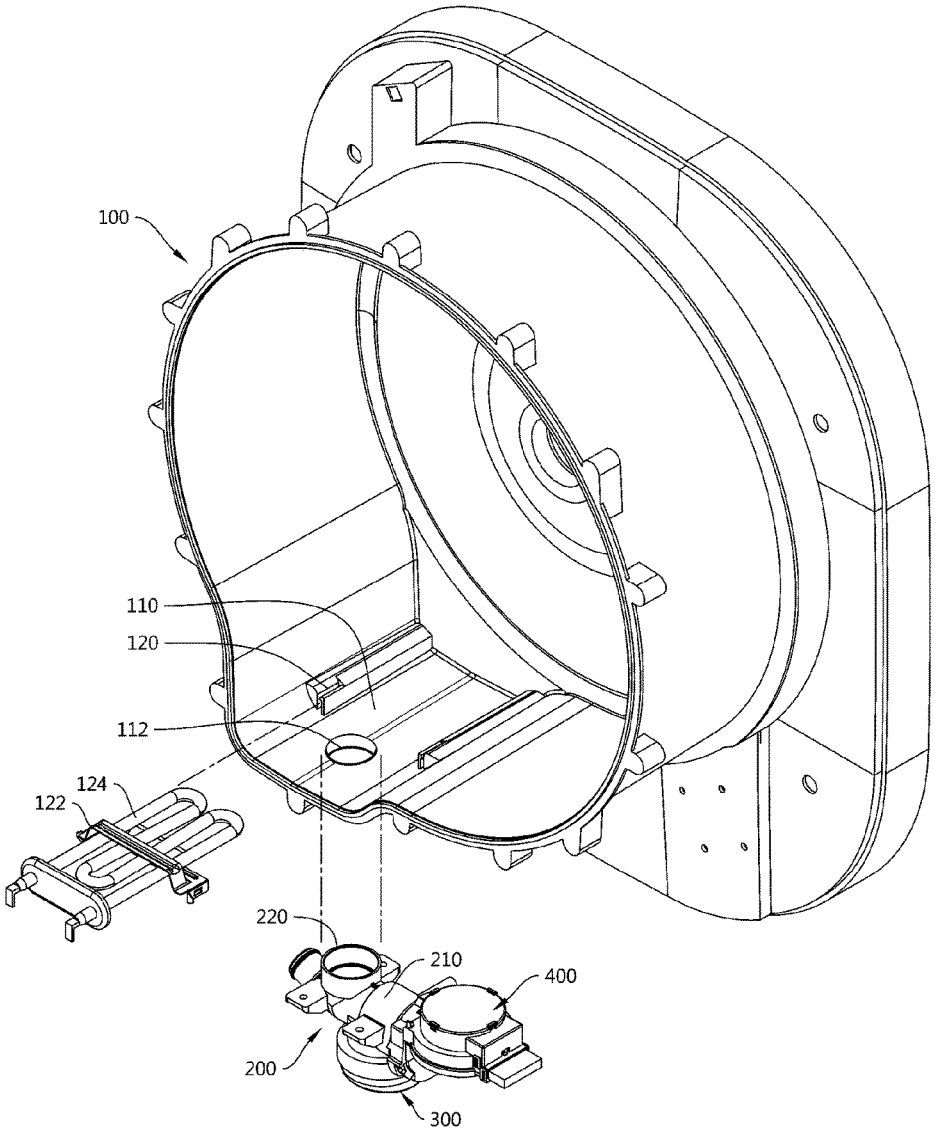
FIG. 1 is a diagram showing a layout of a drainage device and a heater in a wall-mounted washing machine.

In the following detailed description, reference is made to the accompanying drawing, which form a part hereof. The illustrative embodiments described in the detailed description, drawing, and claims are not necessarily meant to be limiting. Other embodiments may be utilized, and other changes may be made, without departing from the spirit or scope of the subject matter presented here.

Advantages and characteristics of the present disclosure and a method of achieving the advantages and characteristics will be clear with reference to an exemplary embodiment described in detail together with the accompanying drawings.

Hereinafter, embodiments of the present disclosure will be described in detail with reference to the accompanying drawings. Exemplary embodiments to be described below are described for easy understanding of the present disclosure and it should be appreciated that various modifications of the present disclosure can be made unlike the exemplary embodiments described herein. However, in the description of the present disclosure, a detailed explanation and a detailed illustration of known related functions and constitutions may be omitted when it is determined to unnecessarily make the subject matter of the present disclosure obscure. The accompanying drawings are not necessarily illustrated according to an actual scale for easy understanding of the present disclosure but some components may be illustrated to be enlarged.

Meanwhile, the terms used in the description are defined considering the functions of the present disclosure and may vary depending on the intention or usual practice of a manufacturer. Therefore, the definitions should be made based on the entire contents of the present specification.

Similar reference numerals may indicate similar elements throughout the specification.

A drainage device for a wall-mounted washing machine according to embodiments of the present disclosure will be described with reference to FIG. 1. FIG. 1 is a diagram showing a layout between an exemplary drainage device and a heater in the wall washer.

As illustrated in FIG. 1, the drainage device is provided at a lower side of a tub 100. In the drainage device, a tub drain 112 is on a bottom of the tub 110, drain housings 200 is installed below the drain 112, caps 300 is mounted on lower sides of the drain housings 200, and a driving unit or actuator 400 is mounted on one side of the drainage device.

The cap 300 is provided for removal of foreign material that is present in the drain housings 200, by opening the drain housing 200.

The driving unit or actuator 400 opens and closes a drain valve unit in the drain housing 200. The drain valve unit is a combination of a valve wall 212 in the drain housing 200 and a valve head 410 in the driving unit 400. In some embodiments, the driving unit or actuator 400 may further comprise a solenoid or solenoid valve.

When the driving unit or actuator 400 is activated, the valve head 410 advances (e.g., moves forward) and retreats (e.g., moves backwards). When the valve head 410 advances, the valve wall 212 closes. When the valve head 410 retreats, the valve wall 212 opens. While the valve wall 212 closes, the level of water in the washer is maintained. While the valve wall 212 opens, the water in the washer discharges or drains from the washing machine.

In an internal structure of the driving unit 400, a driving link 420 is configured to advance and retreat the valve head 410 using power from a motor or magnetic force from a solenoid. The valve head 410 is in a wrinkle pipe or corrugated shape that is extendable, stretchable, and airtight. The driving unit 400 utilizes a known technology and a more detailed description thereof will be omitted.

Hereinafter, a drainage device for a wall-mounted washing machine according to a comparative example will be described with reference to FIGS. 2 to 5. The comparative example is presented by comparison in order to help understand the exemplary embodiments of the present disclosure and is not intended to be an admission of prior or related art.

Figure 2:
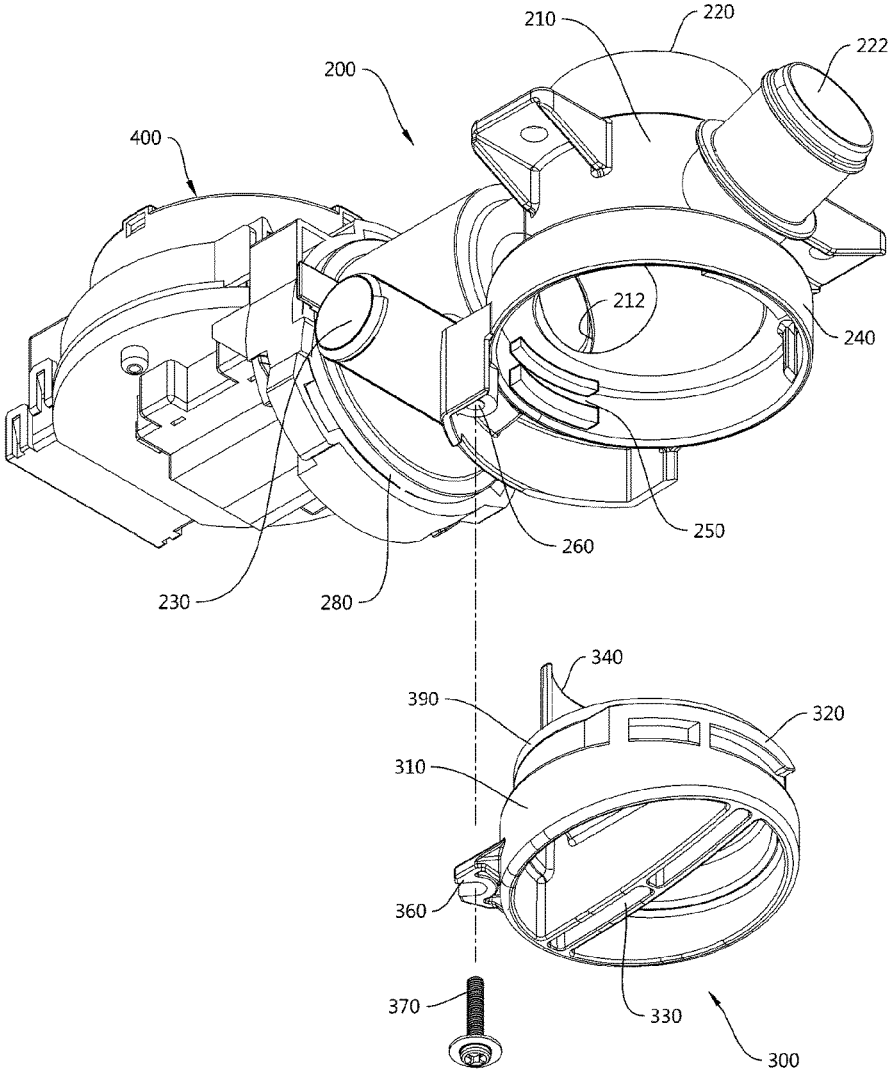
FIG. 2 is a diagram showing a drain housing and a separate cap in a drainage device for a wall-mounted washing machine according to a comparative example.
Figure 3:
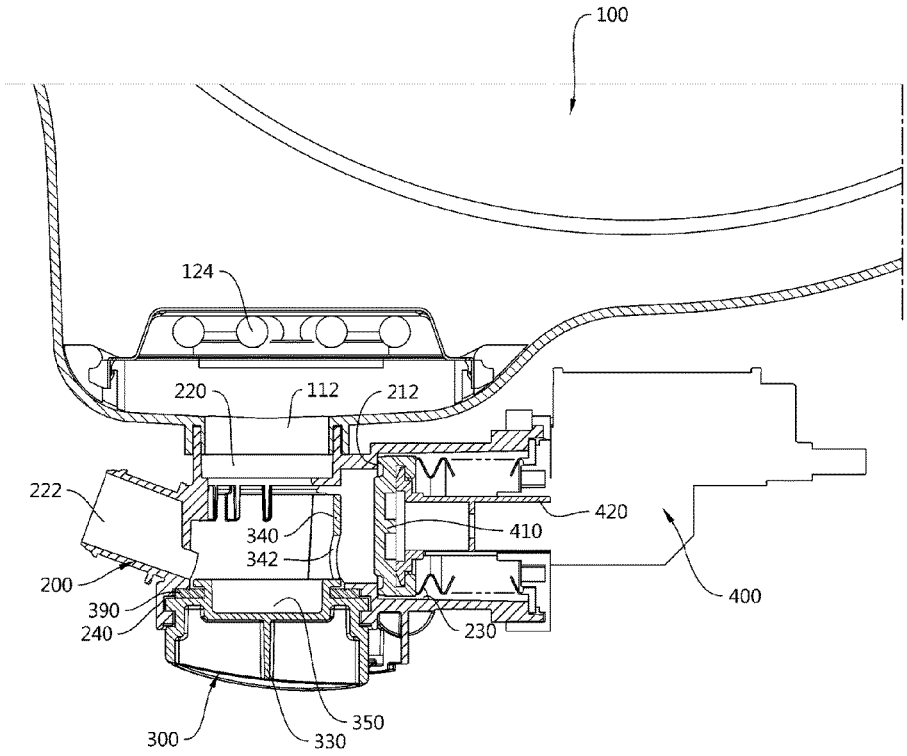
FIG. 3 is a diagram showing a drain that is closed and in which the cap is mounted or secured in the drainage device according to the comparative example.
Figure 4:
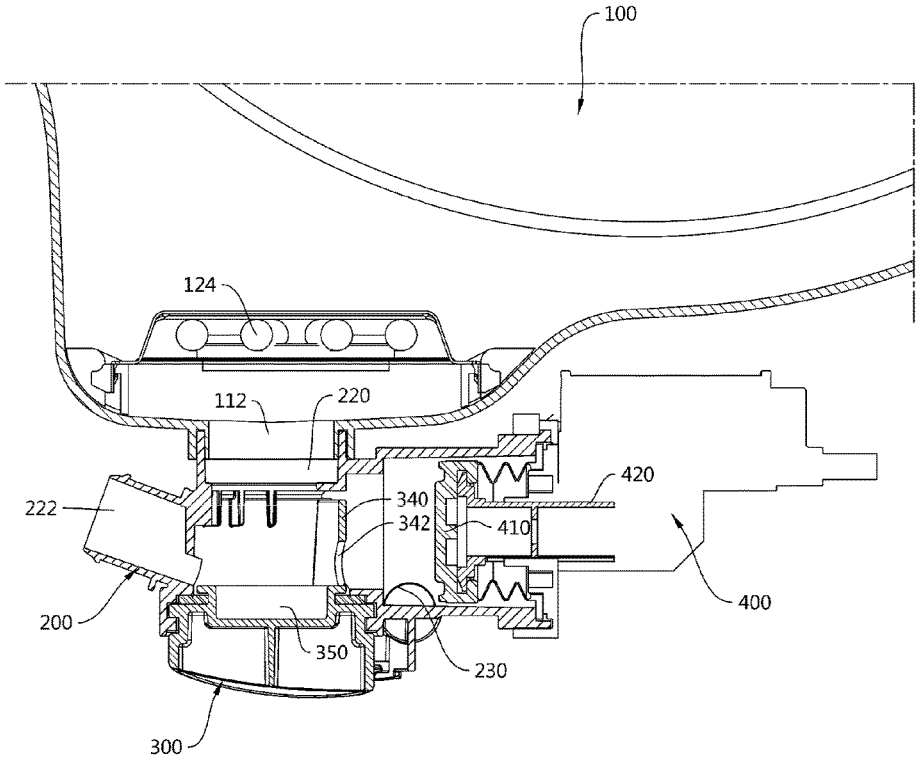
FIG. 4 is a diagram showing the drainage in progress and the cap mounted in the drainage device according to the comparative example.
Figure 5:
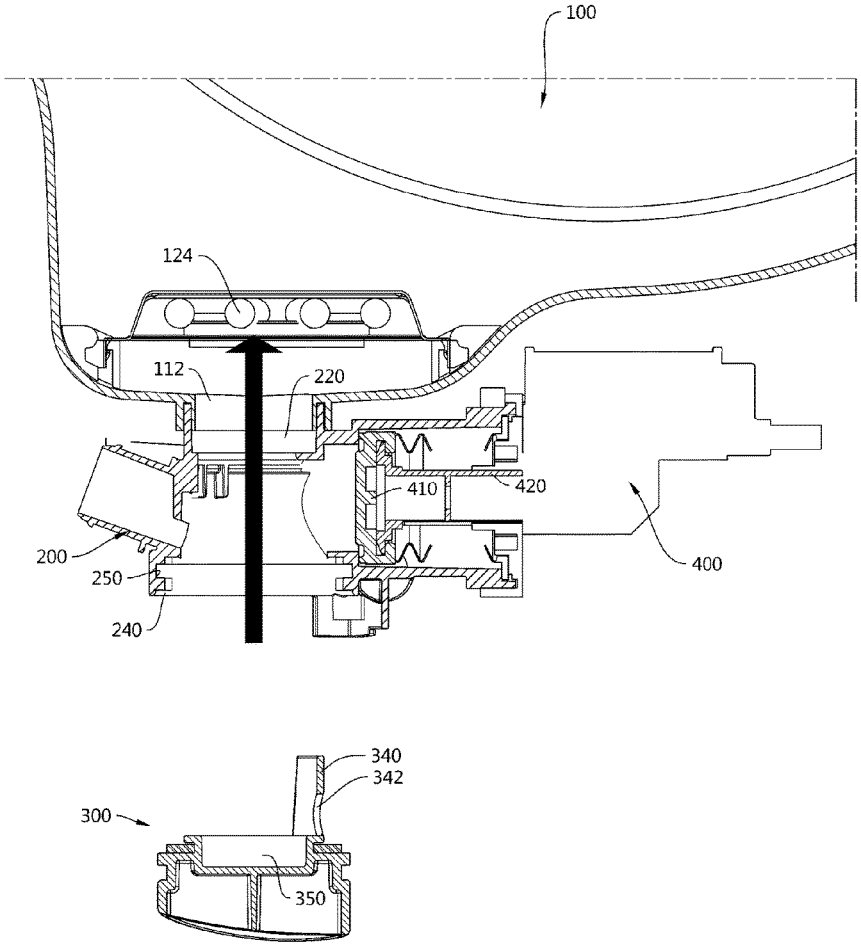
FIG. 5 is a diagram showing the cap removed from the drainage device according to the comparative example.

FIG. 2 is a diagram showing a drain housing and a cap that are separated from each other in a drainage device according to the comparative example. FIG. 3 is a diagram showing a closed drainage path and the cap mounted in the drainage device according to the comparative example. FIG. 4 is a diagram showing an open drainage path (e.g., drainage is in progress) and the cap mounted in the drainage device according to the comparative example. FIG. 5 is a diagram the cap removed from the drainage device according to the comparative example.

In the drain housing 200 according to the comparative example, the valve wall 212 is in a body 210, an inlet 220 is at an upper side of the body 210, and a cap receiver 240 is at a lower side of the body 210. In the drain housing 200 according to the comparative example, the inlet 220 and the cap receiver 240 are disposed linearly (e.g., in a straight line).

A drain 230 is at one side of the body 210 opposite to the inlet 220, relative to the valve wall 212.

A driving unit receiver 280 is at one side of the body 210 opposite to the inlet 220, relative to the valve wall 212. The driving unit 400 is on the driving unit receiver 280 and the valve head 410 is in the driving unit 400 that opens and closes the valve wall 212.

A sub-inlet 222 may be at one side of the inlet 220. Water that overflows from a drum of the washer may flow into the sub-inlet 222.

A binding groove or attachment slot 250 is in the cap receiver 240 and mates with a binding protrusion or ridge 320 in the cap 300. When the cap 300 is axially inserted and rotated, the cap 300 is mounted or secured to the cap receiver 240. When the cap 300 is removed, the cap 300 is rotated in a direction opposite to the direction when the cap 300 is mounted and the cap 300 is pulled out axially.

A boss 260 is at one side of the cap receiver 240. A screw 370 to be described below may be fastened to the boss 260.

In the cap 300 according to the comparative example, a pocket 350 is at an upper body of a cap body 310 and the binding protrusion or ridge 320 is on an outer periphery of the cap body 310.

In the cap 300 according to the comparative example, a filter wall 340 protrudes at an upper side of the cap 300, and a hole or opening 342 is in the filter wall 340. The size of the hole or opening 342 may be small enough to prevent foreign material (e.g., buttons and/or coins) from passing through.

A grip 330 is at a lower side of the cap 300. The grip 330 has a depth that allows a user to grasp the grip 330 using their fingers. As a result, the depth of the pocket 350 proportionally decreases with an increase in the depth of the grip 330. Therefore, the space of the pocket 350 for receiving foreign material is relatively small.

A bracket 360 is on an outer periphery of the cap 300. The screw 370 may be inserted into the bracket 360 and fastened to the boss 260. In the drainage device according to the comparative example, the screw 370 is fastened to prevent the cap 300 from being removed when the cap 300 is on the drain housing 200*a*. As a result, the screw 370 provides or performs a locking function.

However, during the washing process, foreign materials such as coins or buttons may be present, and the foreign materials have adverse effects on the drainage device(s) (e.g., such as clogging the drain). As a result, the foreign materials need to be removed. Since the foreign materials need to be removed, the drainage device should be cleaned periodically by removing the cap 300*a*.

It may be relatively complicated to remove the cap 300 from the drain housing 200 according to the comparative example, due to the need to remove the screw 370, and the size of an inner diameter of the cap receiver 340 may not be large due to the characteristics of the wall-mounted washer machine. As a result, the cap 300 is removed by turning the grip 330 in the cap 300 using one's fingers. Since the gap is small, such a process may be relatively difficult or complicated, and/or may be relatively easy for persons having small fingers, such as children.

As illustrated in FIG. 5, manual removal (e.g., using fingers) of foreign material in the drain housing 200 according to the comparative example, may be performed below a heater 124 when the cap 300 is removed. The heater 124, which heats the internal space in the tub 100, laundry may be very hot. As a result, the hand or finger may contact the cap receiver 240 before the heater 124 is cooled, increasing a risk of injury (e.g., a burn).

Hereinafter, a drainage device for a wall-mounted washing machine according to exemplary embodiments of the present disclosure will be described with reference to FIGS. 6 to 10.

Figure 6:
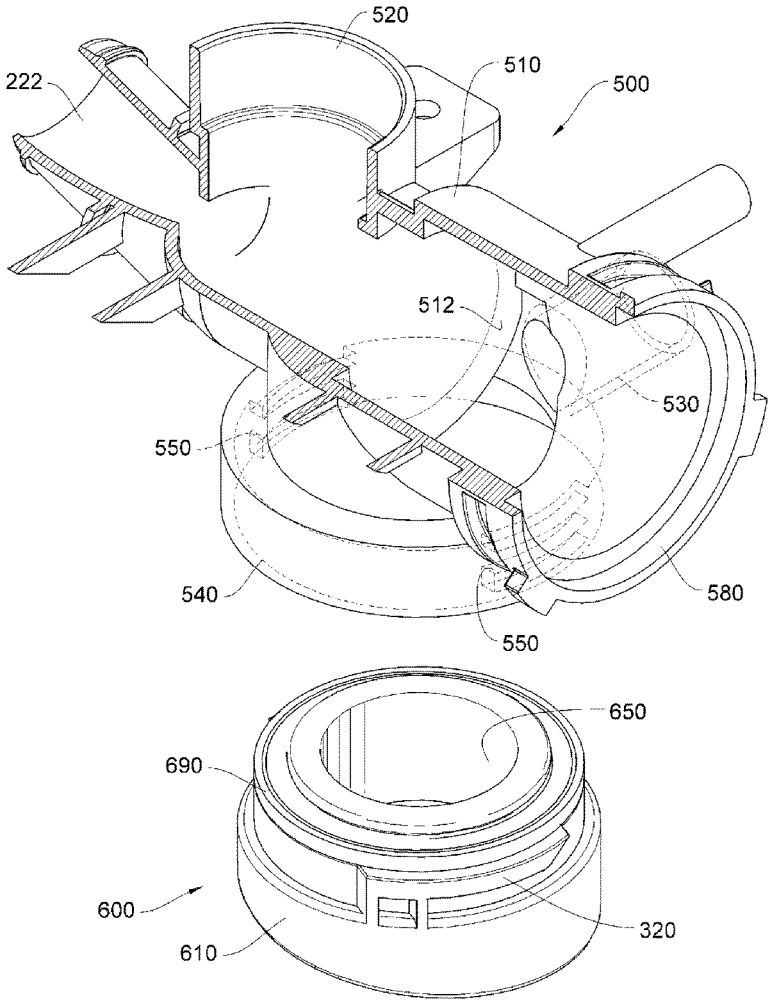
FIG. 6 is a cross-sectional view showing an exemplary drainage device according to embodiments of the present disclosure.
Figure 7:
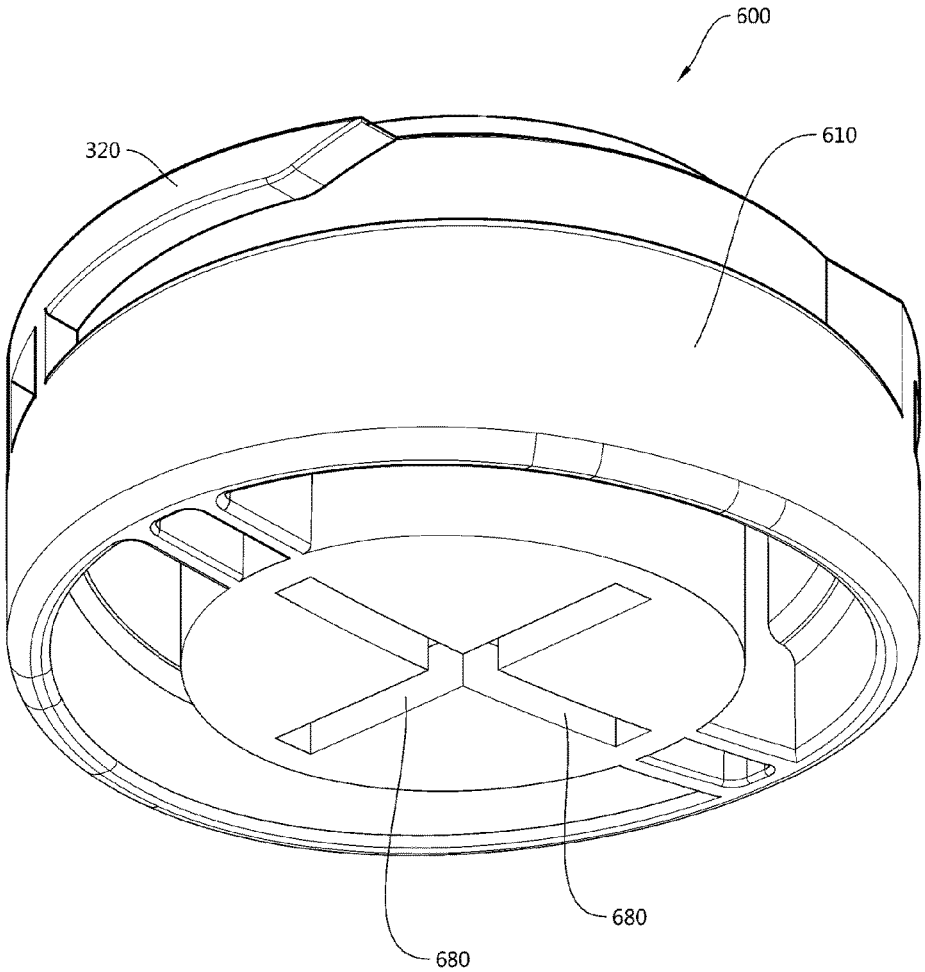
FIG. 7 is a diagram showing an exemplary cap for the drainage device according to embodiments of the present disclosure.
Figure 8:
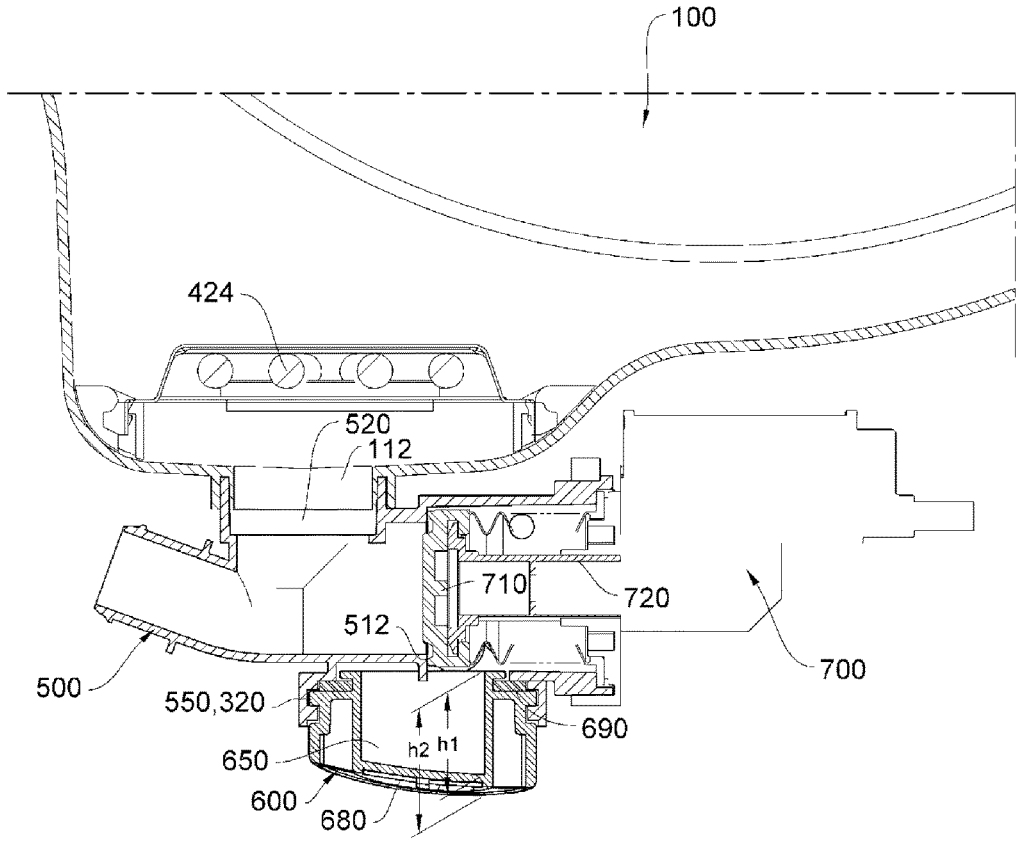
FIG. 8 is a diagram showing an exemplary drainage path that is closed and an exemplary cap mounted in the drainage device according to embodiments of the present disclosure.
Figure 9:
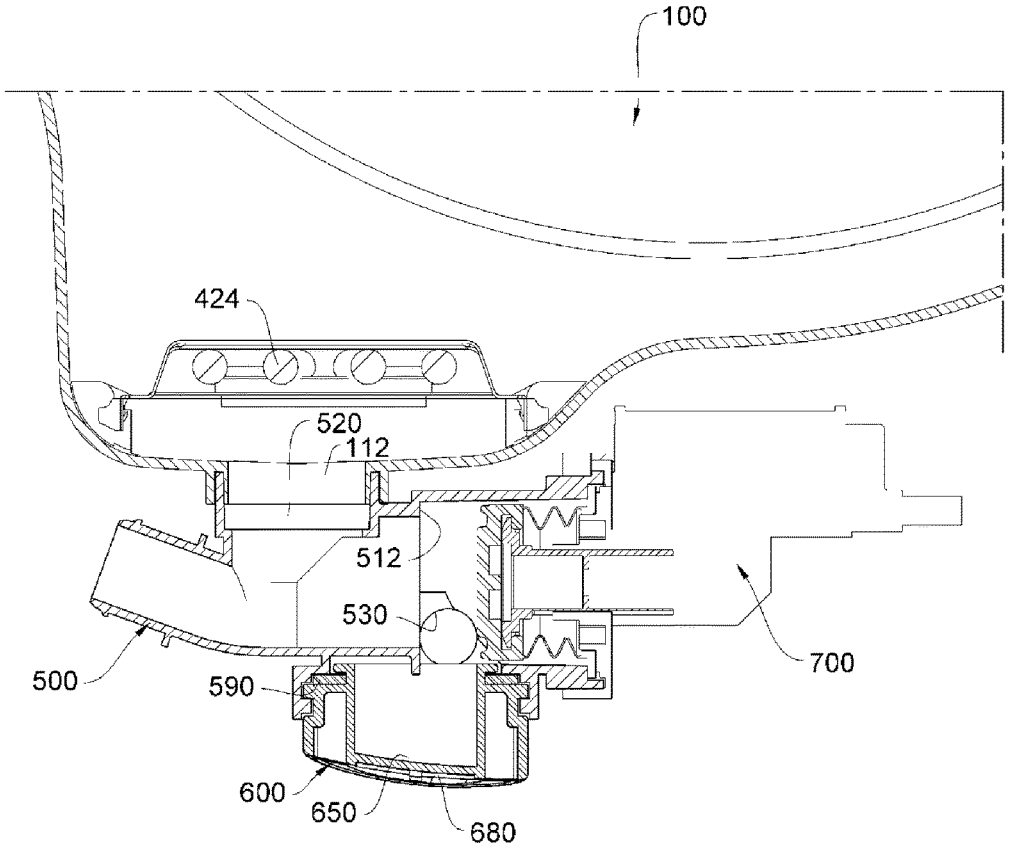
FIG. 9 is a diagram showing an exemplary open drainage path and an exemplary cap in the drainage device according to embodiments of the present disclosure.
Figure 10:
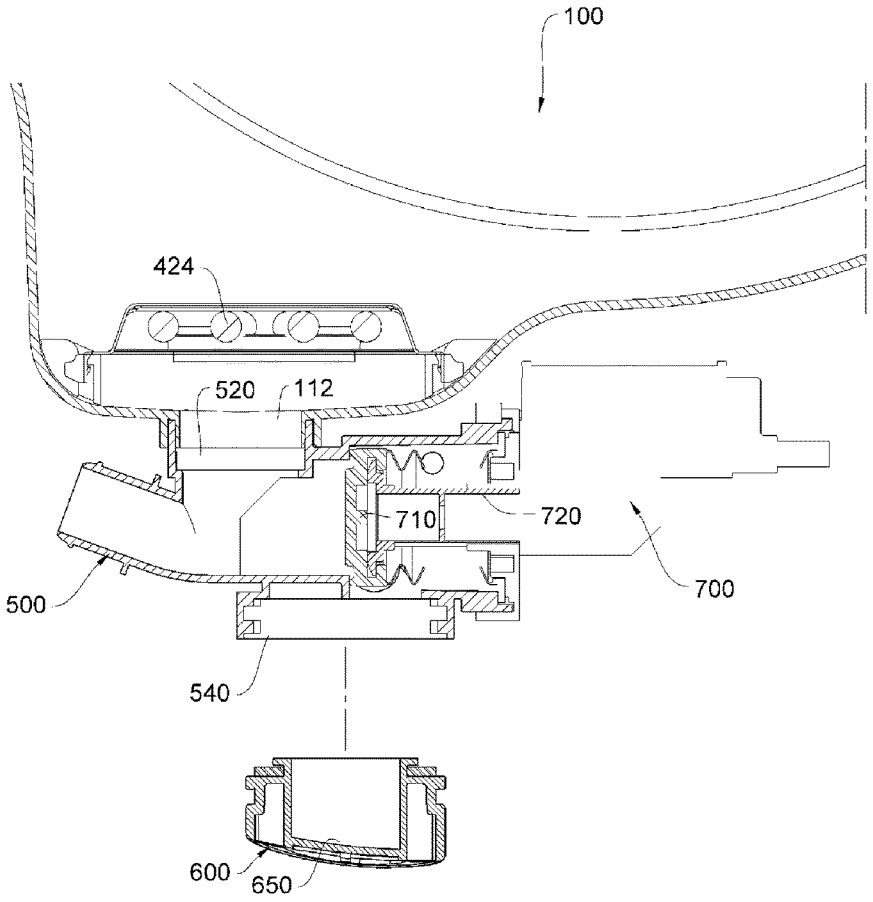
FIG. 10 is a diagram showing an exemplary cap removed from the drainage device according to embodiments of the present disclosure.

FIG. 6 is a cross-sectional view showing an exemplary drainage device for a wall-mounted washing machine according to embodiments of the present disclosure. FIG. 7 is a diagram showing an exemplary cap in the drainage device according to embodiments of the present disclosure. FIG. 8 is a diagram showing an exemplary drainage path that is closed and an exemplary cap in the drainage device according to embodiments of the present disclosure. FIG. 9 is a diagram showing an exemplary open drainage path (e.g., drainage in progress) and an exemplary cap in the drainage device according to embodiments of the present disclosure. FIG. 10 is a diagram showing an exemplary cap removed from the exemplary drainage device according to embodiments of the present disclosure.

In the drainage device for a wall-mounted washing machine according to embodiments of the present disclosure, the same or similar reference numeral refers to the same or similar component as the component disclosed in another figure, and a duplicate description will be omitted.

As illustrated in FIG. 6, in an exemplary drain housing 500 according to embodiment(s) of the present disclosure, the valve wall 512 is in the body 510. The inlet 520 is at one side of the body 510, relative to the valve wall 512, and the drain 530 is at another (e.g., opposite) side thereof. The cap receiver 540 is at one side of the drain 530. As a result, the drain 530 and the cap receiver 540 are oriented in the same direction relative to the valve wall 512.

Therefore, a flow path from the inlet 520 to the cap receiver 540 bends or has a zigzag pattern. Furthermore, a distance from the inlet 520 to the cap receiver 540 is larger than that of the drain housing 500*a* according to the comparative example.

A binding groove or attachment slot 550 is in the cap receiver 540 and a binding protrusion or ridge 520 of the cap 500 is fastened to the binding groove or attachment slot 550.

In the body 510 of the drain housing 500 according to the exemplary embodiment(s) of the present disclosure, a driving unit receiver 580 is on the side of the body 510 opposite the inlet 520, relative to the valve wall 512. The driving unit 700 is installed at the driving unit receiver 580.

In the cap 600 according to the exemplary embodiment(s) of the present disclosure, a pocket 650 is at an upper side and a slot or groove 680 is at a lower side (e.g., the underside) of the cap 600. A packing ring 690 is at an upper side of the cap 600. The packing ring 690 maintains airtightness between the cap 600 and the drain housing 600.

The slot or groove 680 in the cap 600 corresponds to the grip 630 in the cap 600. The depth of the slot or groove 680 is relatively small, compared to that of the grip 630. Therefore, the depth of the pocket 650 may be relatively large. A depth h1 of the pocket 650 may be 80 to 95% of an entire height h2 of the cap 600. Accordingly, in the cap 600 according to the exemplary embodiment(s) of the present disclosure, the pocket 650 may be significantly larger, and capable of collecting more foreign materials.

The tool may be inserted in the slot or groove 680, and the cap 600 may be secured or removed by rotating the tool. The tool may be a screwdriver (e.g., Phillips head screwdriver), a coin, or the like. Accordingly, the cap 600 may be easily secured or removed. Although fastening or releasing the screw 370 is necessary in the comparative example, the screw 370 may be omitted in embodiment(s) of the present disclosure, which is more convenient.

FIG. 8 illustrates a closed drain valve unit, in that the valve head 710 closes a valve wall 512. As a result, the level of water in the washer may be maintained.

FIG. 9 illustrates an open actuator 700, in that the drain valve unit is open and the valve head 710 is spaced apart from the valve wall 512. Therefore, the water in the washer is drained through the drain 530. Since foreign materials in the drainage water sink due to their specific gravity (e.g., density) during the drainage process, foreign materials accumulate in the pocket 650 in the cap 600.

FIG. 10 illustrates a closed actuator or driving unit 700, in that the drain valve unit is closed and the valve head 710 contacts the valve wall 512. The cap 600 is removed from the cap receiver 540.

When the cap 600 is removed from the cap receiver 540, the cap receiver 540 may be opened allowing manual removal (e.g., by fingers) of foreign matter. Even though one or more fingers may pass through the cap receiver 540, the valve head 710 prevents the fingers from contacting the heater 424. As a result, accidents and burns may be prevented.

Alternatively, even though space is secured on the valve wall 512 for opening and closing the valve head 710, the route or flow path from the cap receiver 540 to the inlet 520 is in a zigzag pattern and is relatively long, and fingers may be prevented from contacting the heater 424 and/or other internal components of the washing machine. Thus, accidents and burns may be prevented.

Alternatively, in the cap 600 according to the exemplary embodiment(s) of the present disclosure, the filter wall 340 (e.g., in the cap 300) according to the comparative example may be excluded. In the cap 600 according to the exemplary embodiment(s) of the present disclosure, the bracket 360 (e.g., of the cap 300) according to the comparative example may be excluded. Therefore, an outer shape of the cap 600 may have a shape corresponding to a simplified mold, thereby saving manufacturing cost.

The exemplary embodiments of the present disclosure have been described with reference to the accompanying drawings, but those skilled in the art will understand that the present disclosure may be implemented in another specific form without changing the technical spirit or an essential feature thereof.

Accordingly, it will be understood that the aforementioned exemplary embodiments are described for illustration in all aspects and are not limited, and the scope of the present disclosure shall be represented by the claims to be described below, and it will be construed that all of the changes or modified forms induced from the meaning and the scope of the claims, and an equivalent concept thereof are included in the scope of the present disclosure.

The drainage device for a wall-mounted washing machine according to the present disclosure may advantageously be used to remove foreign materials, such as coins or buttons, from the drainage water.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A drainage device for a wall-mounted washing machine having a tub drain on a bottom of a tub, and a heater on the bottom of the tub, comprising:

a drain housing having a body that is longer in one direction, an inlet which is faced with the tub drain and protrudes towards an outer circumference of the body, a valve wall that is in the body, an opening that is on an opposite side of the body compared to the inlet relative to the valve wall, a cap receiver that surrounds the opening and protrudes towards the outer circumference of the body, a driving unit receiver that is on a side of the drain housing, a drain that protrudes towards the outer circumference of the body between the valve wall and the driving unit receiver, and a flow hole that is in the cap receiver, wherein the drain and the opening are oriented in the same direction relative to the valve wall;

a cap on the cap receiver having a center line which is in a vertical plane of the cap receiver and is spaced apart from a center line which is in a vertical plane of the inlet, configured to collect foreign materials; and a driving unit or actuator in or attached to the driving unit receiver, configured to open and close the valve wall, wherein a route or path from the inlet to the cap receiver has a curved, angled or zigzag pattern.

2. The drainage device of claim 1, wherein in the cap comprises a slot or groove at a lower side of a cap body having a concave shape.

3. The drainage device of claim 1, further comprising a pocket in an upper center of a cap body.

4. The drainage device of claim 3, wherein the pocket has a first depth of 80 to 95% of an entire height of the cap.

5. The drainage device of claim 1, wherein the driving unit receiver or actuated receiver is outside the valve wall.

6. The drainage device of claim 1, wherein the inlet further comprises a sub-inlet.

7. The drainage device of claim 1, further comprising a binding groove or attachment slot in the cap receiver, configured to mate with a binding protrusion or ridge in the cap.

8. The drainage device of claim 7, wherein a pocket is in the upper body of a cap body and the binding protrusion or ridge is on an outer periphery of the cap body.

9. The drainage device of claim 1, further comprising a drain valve unit that opens during drainage activation of the driving unit.

10. The drainage device of claim 1, wherein a valve head is spaced apart in the driving unit or actuator from a valve wall and configured to allow the water in the washer to drain.

11. The drainage device of claim 1, further comprising a packing ring at an upper side of the cap, configured to maintain airtightness between the cap and the drain housing.

12. A drainage device for a wall-mounted washing machine having a tub drain on a bottom of a tub, and a heater on the bottom of the tub, comprising:

a drain housing having a body that is longer in one direction, an inlet which is faced with the tub drain and protrudes towards an outer circumference of the body, a valve wall that is in the body, an opening that is on an opposite side of the body compared to the inlet relative to the valve wall, a cap receiver that surrounds the opening and protrudes towards the outer circumference of the body, a driving unit receiver that is on a side of the drain housing, a drain that protrudes towards the outer circumference of the body between the valve wall and the driving unit receiver, and a flow hole that is in the cap receiver, wherein the drain and the opening are oriented in the same direction relative to the valve wall;

a cap on the cap receiver having a center line which is in a vertical plane of the cap receiver and is spaced apart from a center line which is in a vertical plane of the inlet, having a concave slot or groove at a lower side thereof; and a driving unit or actuator in or attached to the drain housing, configured to open and close the valve wall.

13. The drainage device of claim 12, wherein a route or path from the inlet to the cap receiver has a curved, angled or zigzag pattern.

14. The drainage device of claim 12, further comprising a pocket in at an upper center of the cap, the pocket having a first depth of 80 to 95% of an entire of the cap configured to collect foreign materials in the pocket.

15. The drainage device of claim 12, wherein the driving unit or actuator receiver is outside the valve wall.

16. The drainage device of claim 12, wherein the inlet further comprises a sub-inlet.

17. The drainage device of claim 12, further comprising a binding groove or attachment slot in the cap receiver and configured to mate with a binding protrusion or ridge in the cap.

* * * * *